US010705483B2

(12) United States Patent
Nomura et al.

(10) Patent No.: US 10,705,483 B2
(45) Date of Patent: Jul. 7, 2020

(54) PARTICLE COLLECTING DEVICE AND IMAGE FORMING APPARATUS

(71) Applicant: FUJI XEROX CO., LTD., Tokyo (JP)

(72) Inventors: Yuka Nomura, Kanagawa (JP); Tetsuya Kawatani, Kanagawa (JP); Kokichi Kasai, Kanagawa (JP); Kazunari Ishii, Kanagawa (JP); Ryosuke Nara, Kanagawa (JP); Satoshi Takada, Kanagawa (JP); Akira Numazaki, Kanagawa (JP); Satoru Nishikawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/293,672

(22) Filed: Mar. 6, 2019

(65) Prior Publication Data

US 2020/0019117 A1 Jan. 16, 2020

(30) Foreign Application Priority Data

Jul. 11, 2018 (JP) ..... 2018-131223
Sep. 4, 2018 (JP) ..... 2018-165236

(51) Int. Cl.
*G03G 21/20* (2006.01)
*G03G 15/20* (2006.01)

(52) U.S. Cl.
CPC ..... *G03G 21/206* (2013.01); *G03G 15/2064* (2013.01); *G03G 2221/1645* (2013.01)

(58) Field of Classification Search
CPC ..... G03G 21/206
See application file for complete search history.

(56) References Cited

U.S. PATENT DOCUMENTS 8,116,653 B2 2/2012 Kondo et al.
9,671,753 B2 * 6/2017 Yamashita ..... G03G 21/206
9,977,400 B2 * 5/2018 Yamaguchi ..... G03G 21/206

FOREIGN PATENT DOCUMENTS

JP 2008216301 9/2008
JP 2016162759 9/2016

* cited by examiner

*Primary Examiner* — Walter L Lindsay, Jr.
*Assistant Examiner* — Arlene Heredia
(74) *Attorney, Agent, or Firm* — JCIPRNET

(57) ABSTRACT

A particle collecting device includes a vent pipe having a channel space through which air flows, a first air blower that delivers air including a particle at a first end of the vent pipe into the channel space, a collector that is disposed to block a channel in the channel space at an intermediate part of the vent pipe and that collects the particle included in the air delivered by the first air blower, and a second air blower that collects the air traveling through the collector at a second end of the vent pipe and that delivers the air outward from the channel space. The first and second air blowers operate such that a first pressure in a first channel space extending from the first air blower to the collector and a second pressure in a second channel space extending from the collector to the second air blower are maintained to have a relationship in which the second pressure<the first pressure≤atmospheric pressure. The first and second channel spaces are included in the channel space of the vent pipe.

9 Claims, 14 Drawing Sheets

PARTICLE COLLECTING DEVICE AND IMAGE FORMING APPARATUS

CROSS-REFERENCE TO RELATED APPLICATIONS

This application is based on and claims priority under 35 USC 119 from Japanese Patent Application No. 2018-131223 filed Jul. 11, 2018 and Japanese Patent Application No. 2018-165236 filed Sep. 4, 2018.

BACKGROUND

(i) Technical Field

The present disclosure relates to particle collecting devices and image forming apparatuses.

(ii) Related Art

Japanese Unexamined Patent Application Publication No. 2016-162759 (paragraphs [0002] and [0034] to [0036], FIG. 6) describes a known technology in the related art for filtering exhaust air by collecting particles therefrom using a collector, such as a filter, and then discharging the air into the atmosphere.

Japanese Unexamined Patent Application Publication No. 2016-162759 describes an electric-apparatus option device including a duct for causing exhaust air from multiple exhaust ports of an electric apparatus to merge and discharging the exhaust air into the atmosphere from a single outlet, a filter and an electric fan contained in front of the outlet of the duct, an airflow sensor that detects whether or not the exhaust air is discharged from one of the multiple exhaust ports, and a controller that controls the operation of the electric fan based on an output of the airflow sensor. In the option device, the airflow sensor is disposed in the exhaust port with the highest exhaust speed among the multiple exhaust ports.

SUMMARY

Aspects of non-limiting embodiments of the present disclosure relate to a particle collecting device and an image forming apparatus that may collect particles while preventing the particles from leaking outside a vent pipe.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a particle collecting device including a vent pipe, a first air blower, a collector, and a second air blower. The vent pipe has a channel space through which air flows. The first air blower delivers air including a particle at a first end of the vent pipe into the channel space. The collector is disposed to block a channel in the channel space at an intermediate part of the vent pipe and collects the particle included in the air delivered by the first air blower. The second air blower collects the air traveling through the collector at a second end of the vent pipe and delivers the air from the channel space. The first air blower and the second air blower operate such that a first pressure in a first channel space extending from the first air blower to the collector and a second pressure in a second channel space extending from the collector to the second air blower are maintained to have a relationship in which the second pressure<the first pressure≤atmospheric pressure. The first channel space and the second channel space are included in the channel space of the vent pipe.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

First Exemplary Embodiment

Figure 1:
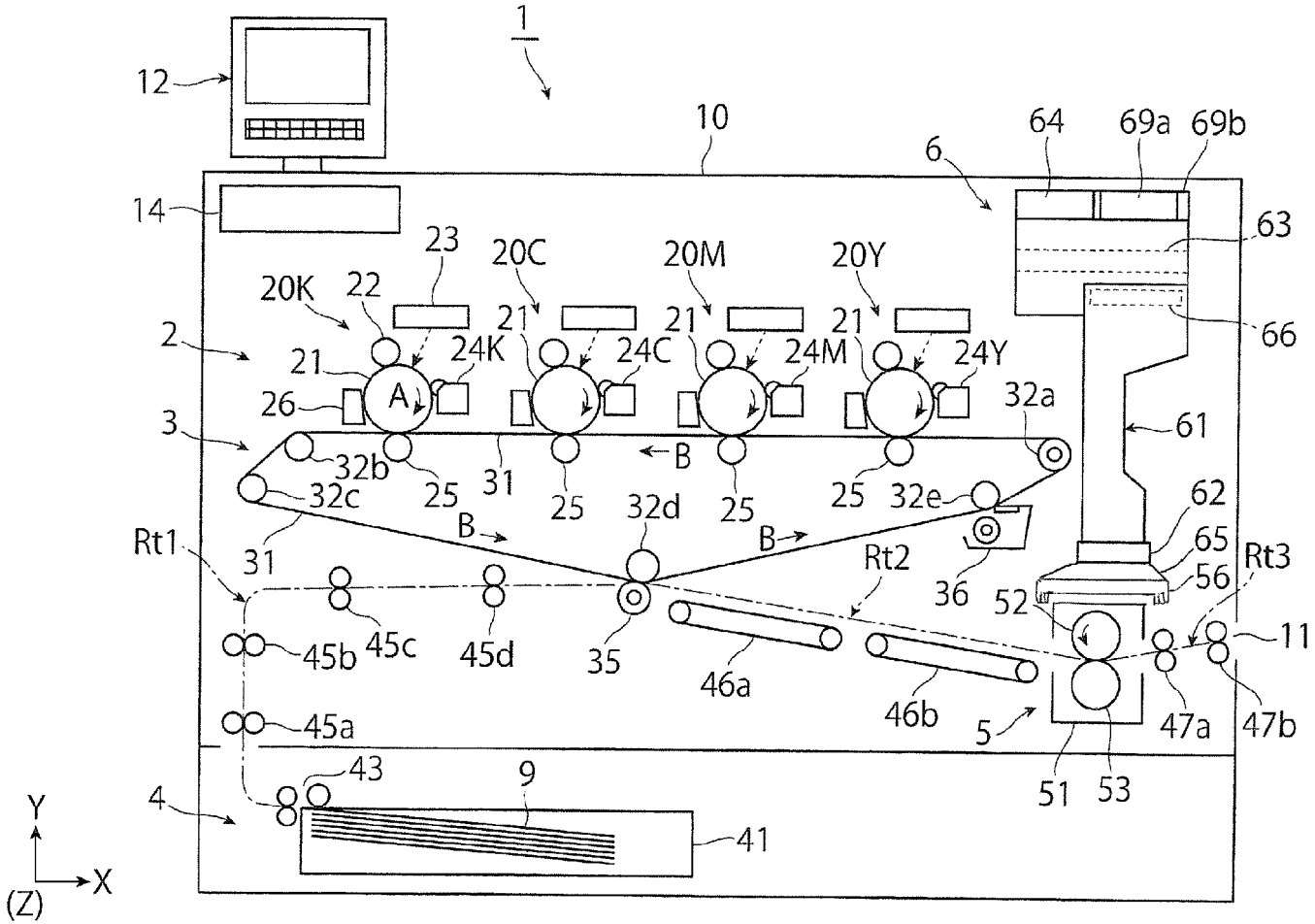
FIG. 1 schematically illustrates the configuration of an image forming apparatus according to a first exemplary embodiment.
Figure 2:
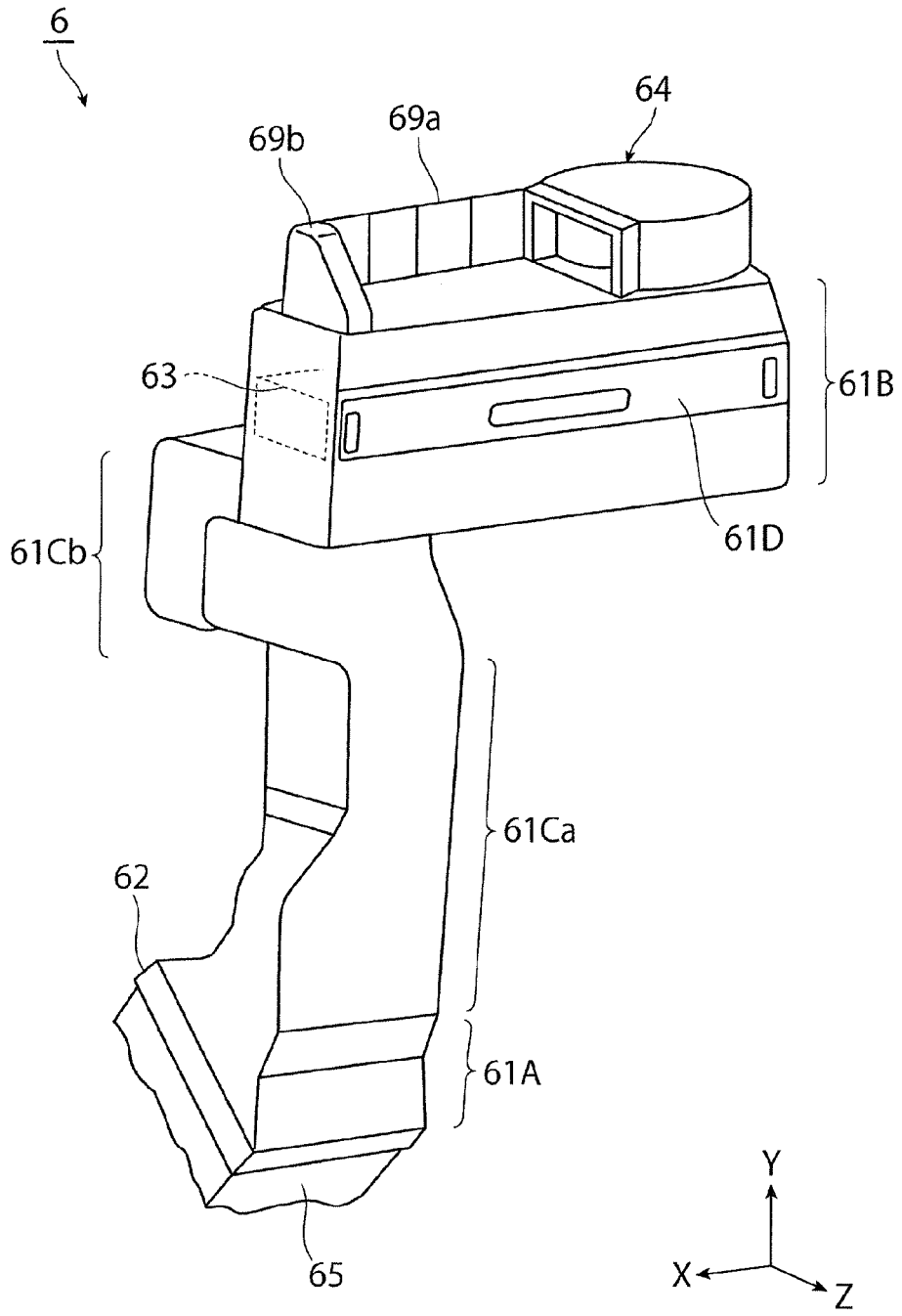
FIG. 2 is a perspective view schematically illustrating the configuration of a particle collecting device according to the first exemplary embodiment.
Figure 3:
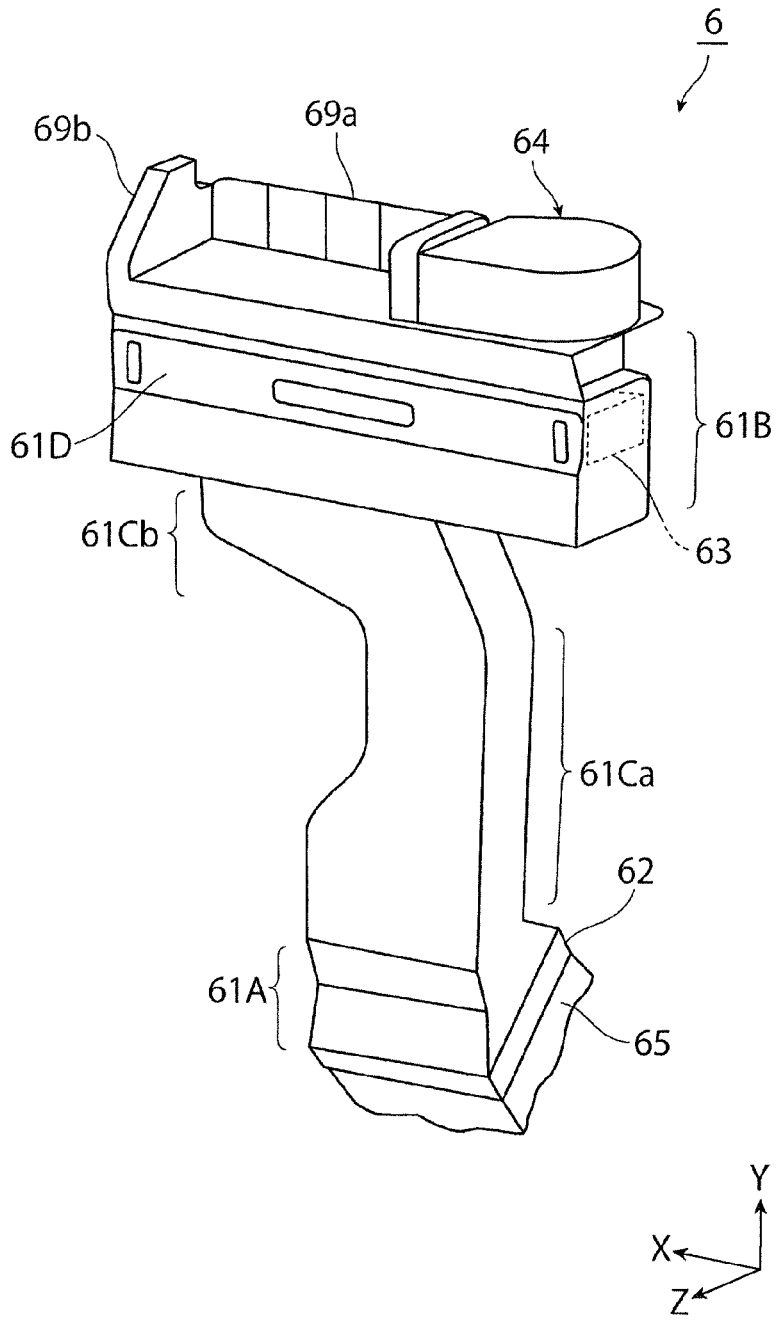
FIG. 3 is a perspective view schematically illustrating the particle collecting device in FIG. 2, as viewed from a different direction.

FIGS. 1 to 3 illustrate a first exemplary embodiment of the present disclosure. FIG. 1 illustrates the overall configuration of an image forming apparatus 1 according to the first exemplary embodiment, and FIGS. 2 and 3 illustrate a particle collecting device according to the first exemplary embodiment.

Reference signs X, Y, and Z in the drawings indicate the width, height, and depth directions, respectively, in a three-dimensional space assumed in the drawings. Furthermore, in FIG. 1, the round symbol intersecting the arrows of the X and Y directions indicates that the Z direction is oriented inward in the depth direction.

Overall Configuration of Image Forming Apparatus

The image forming apparatus 1 employs electrophotography to form an image onto a sheet 9 as an example of a recording medium. For example, the image forming apparatus 1 according to the first exemplary embodiment serves as a printer that forms an image corresponding to image information acquired from an external apparatus, such as an information terminal. The image information constitutes a text, graphic, pattern, or photographic image.

As shown in FIG. 1, the image forming apparatus 1 has a housing 10. Within the housing 10 are disposed an image forming device 2, an intermediate transfer unit 3, a sheet feeding unit 4, a fixing unit 5, and a particle collecting device 6. A single-dot chain line shown in FIG. 1 indicates a transport path used when the sheet 9 is transported within the housing 10.

The housing 10 is a box-shaped structural object and is constituted of various types of support members and facing materials. An operable unit 12 is disposed outside the housing 10. For example, the operable unit 12 includes a display unit that displays various types of information, as well as an input unit used for performing a selecting operation and an input operation. A controller 14 is disposed inside the housing 10. The controller 14 has a function of comprehensively controlling various types of operation in the image forming apparatus 1. The controller 14 is constituted of, for example, an arithmetic processing circuit, a storage unit, an input-output unit, and a control unit that controls these units.

The image forming device 2 employs electrophotography to form a toner image constituted of a toner as a developer. As shown in FIG. 1, the image forming device 2 according to the first exemplary embodiment includes four image forming units 20Y, 20M, 20C, and 20K that individually form toner images of four colors, such as yellow (Y), magenta (M), cyan (C), and black (K) colors.

The four image forming units 20 (Y, M, C, and K) each have a photoconductor drum 21 as an example of a photoconductor that is driven so as to rotate in the direction indicated by an arrow A. Each photoconductor drum 21 is surrounded by devices, such as a charging device 22, an exposure device 23, a developing device 24 (Y, M, C, or K), a first-transfer device 25, and a first cleaning device 26. Although the reference signs 21 to 26 are all indicated for the image forming unit 20K in FIG. 1, only some of the reference signs are indicated for the image forming units 20 of the remaining colors (Y, M, and C), and the remaining reference signs are not indicated.

The charging device 22 electrostatically charges the outer peripheral surface serving as an image formation region of the photoconductor drum 21 to a predetermined potential. For example, the charging device 22 includes a charging member, such as a roller, that is brought into contact with the image formation region on the outer surface of the photoconductor drum 21 and that is supplied with a charging current. The exposure device 23 radiates light generated from the image information onto the electrostatically-charged outer peripheral surface of the photoconductor drum 21 so as to form an electrostatic latent image of the corresponding color component. The exposure device 23 operates by receiving an image signal obtained by an image processor (not shown) separating the image information input from the outside into color components of the four colors (Y, M, C, and K). The developing device 24 (Y, M, C, or K) develops the electrostatic latent image of the color component formed on the corresponding photoconductor drum 21 by supplying a toner of the color corresponding to that color component to the electrostatic latent image, so as to obtain a visible toner image of any one of the four colors (Y, M, C, and K).

The first-transfer device 25 first-transfers the toner image formed on the photoconductor drum 21 in the corresponding image forming unit 20 (Y, M, C, or K) to the intermediate transfer unit 3. The first-transfer device 25 includes a first-transfer member, such as a roller, that comes into contact with the outer peripheral surface of the photoconductor drum 21 via, for example, an intermediate transfer belt 31 to be described later and that is supplied with a first-transfer current. The first-transfer device 25 constitutes a part of the intermediate transfer unit 3, which will be described later. The first cleaning device 26 cleans the outer peripheral surface of the photoconductor drum 21 by removing waste, such as toner, therefrom.

The intermediate transfer unit 3 temporarily retains and transports the toner images first-transferred from the image forming units 20 (Y, M, C, and K) in the image forming device 2, and ultimately second-transfers the toner images onto the sheet 9. As shown in FIG. 1, the intermediate transfer unit 3 according to the first exemplary embodiment is of a belt type that uses the intermediate transfer belt 31 to retain the toner images first-transferred from the photoconductor drums 21 of the image forming units 20 (Y, M, C, and K) and to transport the toner images to a second-transfer position.

The intermediate transfer belt 31 is an annular belt capable of retaining toner images by an electrostatic effect. The intermediate transfer belt 31 is supported in a state where it receives predetermined tension from multiple support rollers 32*a* to 32*e* such that the intermediate transfer belt 31 rotates (revolves) while sequentially passing through first-transfer positions where the image forming units 20 (Y, M, C, and K) perform a first-transfer process. Furthermore, the intermediate transfer belt 31 is rotationally driven in the direction indicated by an arrow B by the support roller 32*a* as a drive roller. The first-transfer positions are where the intermediate transfer belt 31 and the first-transfer devices 25 face each other.

The above-described first-transfer devices 25 in the image forming units 20 (Y, M, C, and K) are disposed at the inner peripheral side of the intermediate transfer belt 31. A second-transfer device 35 and a second cleaning device 36 are disposed at the outer peripheral side of the intermediate transfer belt 31.

The second-transfer device 35 second-transfers the toner images first-transferred on the outer peripheral surface of the intermediate transfer belt 31 onto the sheet 9. The second-transfer device 35 includes, for example, a second-transfer member, such as a roller, that comes into contact with the outer peripheral surface of the intermediate transfer belt 31 supported by the support roller 32*d* as a second-transfer backup roller. The support roller 32*d* and the second-transfer member are supplied with a second-transfer current. The second cleaning device 36 cleans the outer peripheral surface of the intermediate transfer belt 31 by removing waste, such as toner, therefrom.

The sheet feeding unit 4 accommodates therein sheets 9 to be used for image formation and also feeds each sheet 9 to the second-transfer position where a second-transfer process is performed by the intermediate transfer unit 3. As shown in FIG. 1, the sheet feeding unit 4 according to the first exemplary embodiment includes a sheet container 41 and a feeding device 43. The second-transfer position is where the intermediate transfer belt 31 in the intermediate transfer unit 3 and the second-transfer device 35 face each other.

For example, the sheet container 41 is attached to the housing 10 in a withdrawable manner and accommodates sheets 9 of desired sizes and types in a stacked state on a stacking plate (not shown). The feeding device 43 feeds the sheets 9 one-by-one from the sheet container 41. The sheets 9 may be of any type of media that may be transported along the transport path in the housing 10 and on which toner images may be retained and fixed. Examples of such media that may be used include plain paper, coated paper, and cardboard.

The fixing unit 5 fixes the toner images, which are unfixed images, transferred on the sheet 9 onto the sheet 9. As shown in FIG. 1, the fixing unit 5 according to the first exemplary embodiment includes a thermal rotating member 52 and a pressure rotating member 53 that are disposed in the internal space of a box-shaped housing 51 having an inlet and an outlet for the sheet 9.

The thermal rotating member 52 is a structural object of a roller type, a belt type, or a belt-nip type. The thermal rotating member 52 is supported while being heated to a predetermined temperature by a heater (not shown) and rotationally driven in the direction indicated by the arrow by a driver (not shown). The pressure rotating member 53 is a structural object of a roller type, a belt type, or a belt-nip type. The pressure rotating member 53 is disposed in contact with the thermal rotating member 52 with a predetermined pressure by a pressurizing unit (not shown), and is supported so as to be slave-rotated in accordance with the rotation of the thermal rotating member 52.

In the fixing unit 5, a region where the thermal rotating member 52 and the pressure rotating member 53 are in contact with each other serves as a fixing section (fixing nip section) FN where the sheet 9 having the toner images transferred thereon travels through so as to undergo a fixing process by receiving heat and pressure.

As shown in FIG. 1, the image forming apparatus 1 is provided with transport paths, to be described below, inside the housing 10.

For example, a sheet-feed transport path Rt1 along which the sheet 9 fed from the sheet feeding unit 4 is transported to the second-transfer position is provided between the sheet feeding unit 4 and the second-transfer position of the intermediate transfer unit 3. The sheet-feed transport path Rt1 includes, for example, multiple transport rollers 45*a* to 45*d* and multiple transport guide members (not shown).

Furthermore, a relay transport path Rt2 along which the sheet 9 having undergone the second-transfer process is transported to the fixing unit 5 is provided between the fixing unit 5 and the second-transfer position of the intermediate transfer unit 3. The relay transport path Rt2 includes, for example, sheet transport devices 46*a* and 46*b* of belt transport types.

Moreover, an output transport path Rt3 along which the sheet 9 having undergone the fixing process is transported to a sheet outlet 11 in the housing 10 is provided between the fixing unit 5 and the sheet outlet 11. The output transport path Rt3 includes, for example, transport rollers 47*a* and 47*b* and a transport guide member (not shown).

According to the image forming apparatus 1 having the above-described configuration, various types of images to be described below may be formed (printed) by selectively actuating the four image forming units 20 (Y, M, C, and K) in the image forming device 2.

For example, by actuating all of the image forming units 20 (Y, M, C, and K), a multicolor image, that is, a so-called full-color image, constituted of a combination of toners of four colors (Y, M, C, and K) may be formed on the sheet 9 via the intermediate transfer unit 3 and the fixing unit 5. Furthermore, by actuating any one of the image forming units 20 (Y, M, C, and K), a monochromatic image constituted of a toner of a single color may be formed on the sheet 9 via the intermediate transfer unit 3 and the fixing unit 5. Moreover, by actuating two or three of the image forming units 20 (Y, M, C, and K), a multicolor image constituted of toners of multiple colors, other than a full-color image, may be similarly formed.

Configuration Related to Particle Collector

The particle collecting device 6 described above collects particles generated from the fixing unit 5 and the vicinity thereof in the image forming apparatus 1.

For example, the particles to be collected by the particle collecting device 6 are generated when a component, such as wax, contained in toner vaporizes by being heated during the fixing process and is subsequently cooled, and each have a particle diameter of 1 μm. The particles desirably include so-called ultra fine particles (UFP) with a particle diameter of 0.1 μm or smaller or smaller than 0.1 μm.

As shown in FIGS. 2 to 6, the particle collecting device 6 includes a vent pipe 61, a first air blower 62, a collector 63, and a second air blower 64. The particle collecting device 6 according to the first exemplary embodiment is configured to collect particles generated in the fixing unit 5.

The vent pipe 61 is a structural object having a channel space 60 that allows air to flow therethrough.

As shown in FIGS. 1 to 5, the vent pipe 61 according to the first exemplary embodiment is disposed such that a first end is connected to a collection duct 56 provided above the housing 51 of the fixing unit 5 and a second end is connected to the second air blower 64. The collection duct 56 collects and takes in air existing in the housing 51 and the vicinity thereof from multiple intake ports 56*a* provided above the inlet and the outlet for the sheet 9 in the housing 51 of the fixing unit 5.

The vent pipe 61 extends upward from a rear end of the housing 51 in the fixing unit 5 along a rear inner wall of the housing 10 in the image forming apparatus 1 and extends to a position in front of an exhaust port 13 (FIG. 5) provided at an upper rear corner of the housing 10.

More specifically, as shown in FIGS. 2 and 3, the vent pipe 61 is a structural object including an expanded lower-end section 61A having an expanded truncated-pyramidal-shaped channel space 60 such that the first air blower 62 is disposable therein, an expanded upper-end section 61B having an expanded rectangular-parallelepiped-shaped channel space 60 such that the collector 63 is disposable therein, and an intermediate section 61C having a cross-sectionally rectangular-shaped channel space 60 and extending to connect the expanded lower-end section 61A and the expanded upper-end section 61B.

Figure 5:
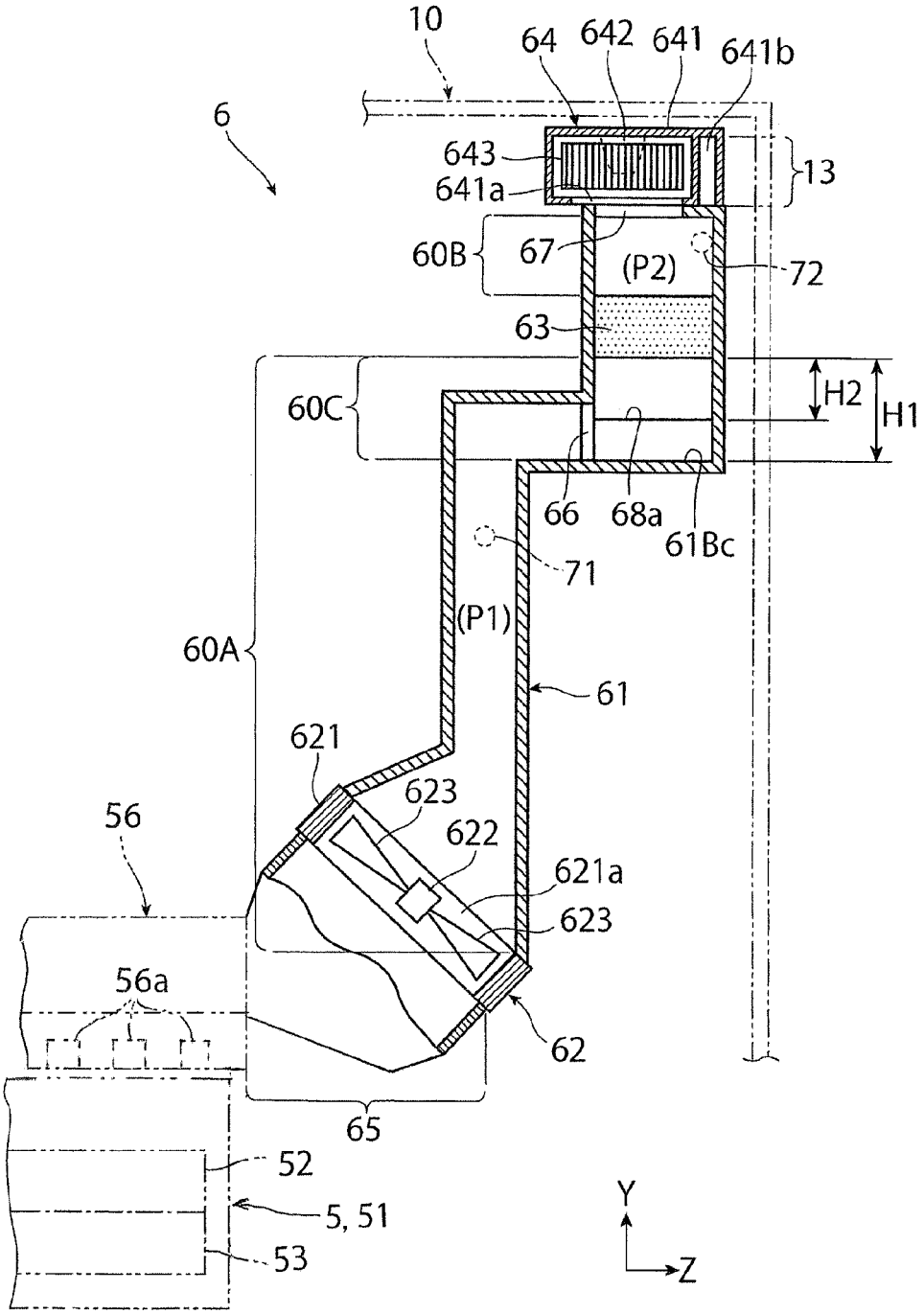
FIG. 5 is a cross-sectional view schematically illustrating the particle collecting device in FIG. 2.

As shown in FIGS. 1 and 5, a collection connector 65 that collects air existing in the housing 51 and the vicinity thereof in the fixing unit 5 via the collection duct 56 is disposed so as to connect between the expanded lower-end section 61A of the vent pipe 61 or the first air blower 62 and the fixing unit 5.

Furthermore, as shown in FIGS. 2 and 3, the intermediate section 61C of the vent pipe 61 includes an intermediate lower section 61Ca extending upward from the expanded lower-end section 61A, and also includes an intermediate upper section 61Cb that expands and extends upward from the intermediate lower section 61Ca, bends substantially in the horizontal direction, and connects to a part of the expanded upper-end section 61B.

Furthermore, as shown in FIGS. 4 to 7, the expanded upper-end section 61B of the vent pipe 61 is provided with an inlet 66 that is connected to the intermediate section 61C (i.e., the intermediate upper section 61Cb) and into which air flows, and an outlet 67 from which the air passing through the collector 63 is discharged to the second air blower 64.

The first air blower 62 blows air including particles at the first end of the vent pipe 61 into the channel space 60.

It is desirable that the first air blower 62 have performance for efficiently collecting particles generated in the fixing unit 5 and the vicinity thereof together with air and for blowing the air and the particles into the channel space 60 of the vent pipe 61.

In the first exemplary embodiment, the first air blower 62 used is an axial fan. Furthermore, in the first exemplary embodiment, the first air blower 62 is disposed in the widest part of the channel space 60 in the expanded lower-end section 61A of the vent pipe 61.

Figure 6:
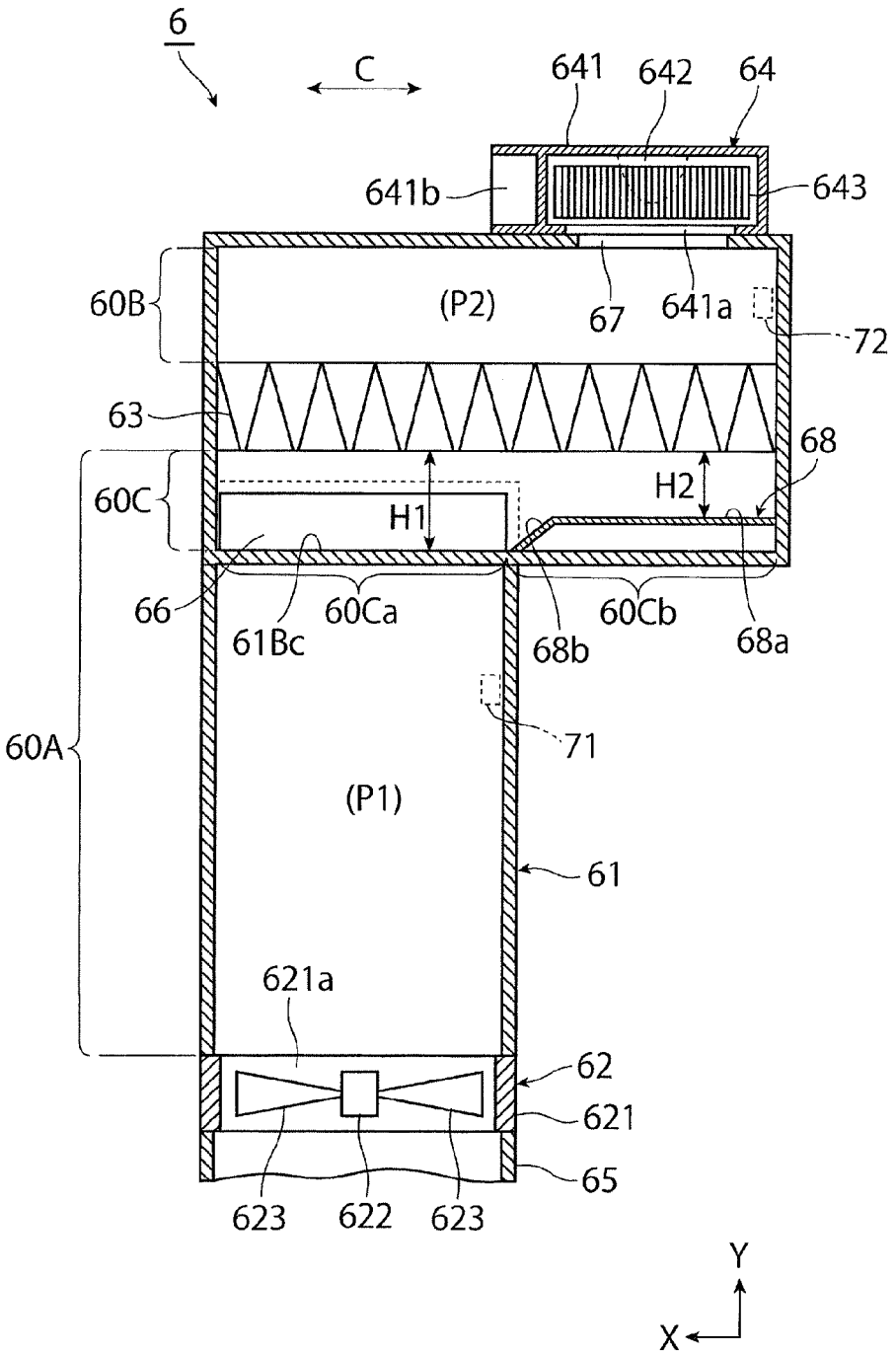
FIG. 6 is a cross-sectional view schematically illustrating the particle collecting device, as viewed from a different angle.
Figure 7:
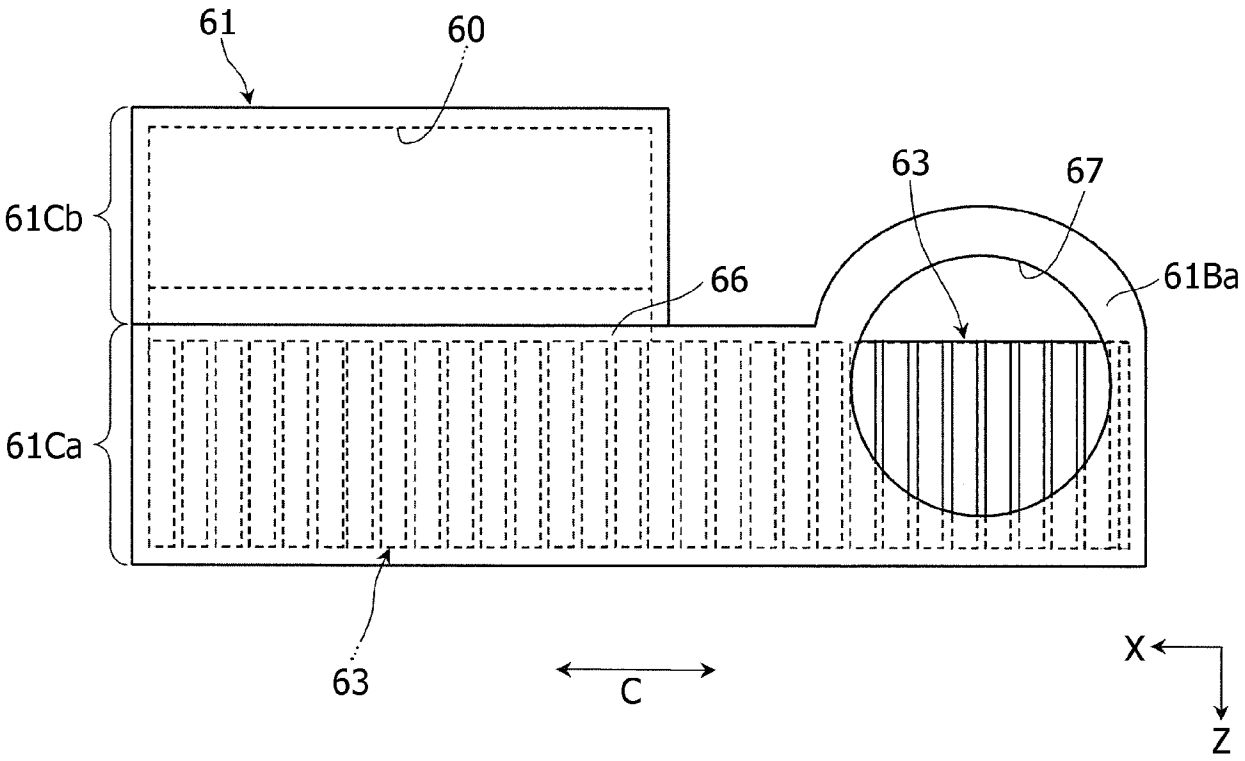
FIG. 7 is a plan view schematically illustrating an upper end of a vent pipe in the particle collecting device.

For example, as shown in FIGS. 5 and 6, the axial fan as the first air blower 62 is constituted of a frame 621 having a through-section 621*a* that is circular in cross section, a shaft 622 rotatably supported in the through-section 621*a* of the frame 621 and containing a drive motor (reference sign 625 in FIG. 8), and multiple blades 623 provided around the shaft 622.

The collector 63 is disposed to block the channel in the channel space 60 at an intermediate part of the vent pipe 61, and collects particles included in air blown in by the first air blower 62.

In the first exemplary embodiment, the collector 63 is disposed so as to extend crosswise across the channel space 60 at a substantially intermediate position thereof in the expanded upper-end section 61B of the vent pipe 61. The collector 63 has a relatively long shape in one of the crosswise directions. This crosswise direction of the collector 63 is a longitudinal direction C of the collector 63.

In the first embodiment, the collector 63 used has performance for collecting particles included in air, particularly, ultra fine particles. In detail, the collector 63 used is a filter having a relatively high initial pressure loss (e.g., 50 Pa or higher when the flow rate is 1 m/s) and having a particle collection efficiency of 95% or higher.

Figure 4:
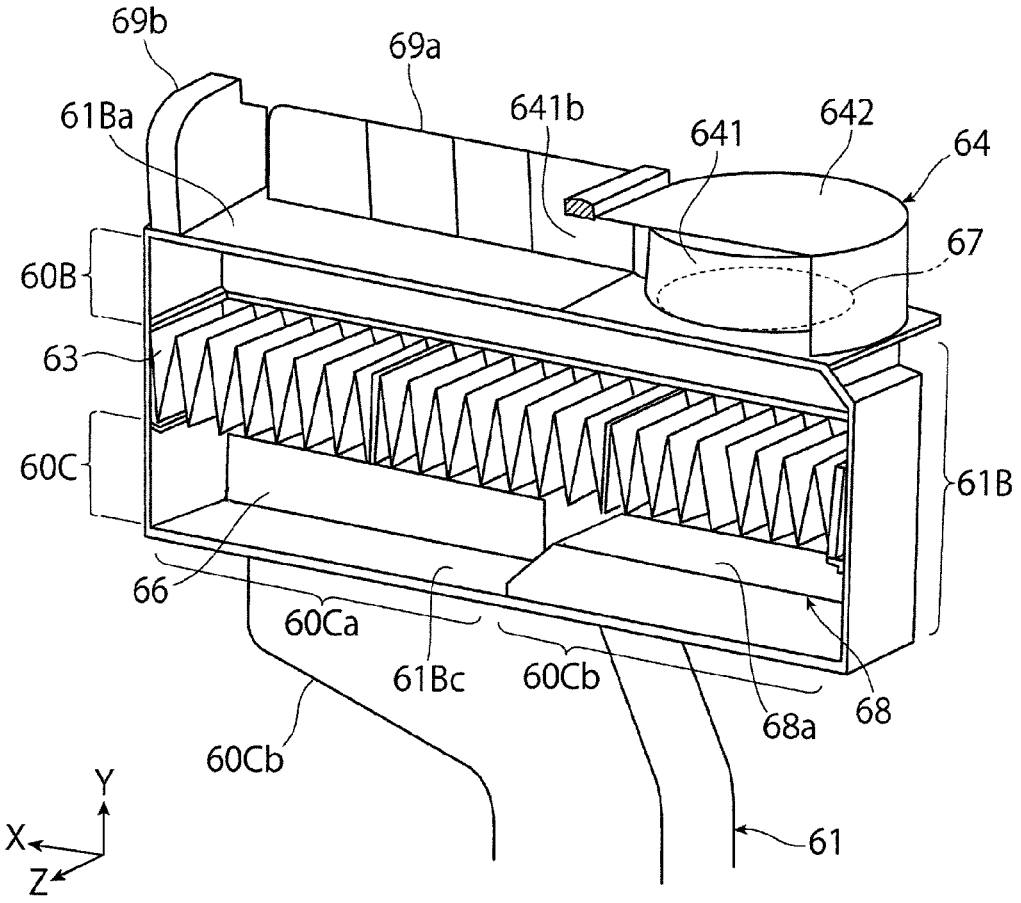
FIG. 4 is an enlarged perspective view schematically illustrating the interior of a part of the particle collecting device in FIG. 3.

Furthermore, as shown in FIGS. 4 and 5, in the first exemplary embodiment, the collector 63 used is a filter of a pleated type (i.e., has a folded shape with successive protrusions and depressions). As shown in FIGS. 2 and 3, the filter used as the collector 63 is replaceable by being detached through an attachment port provided in correspondence with the position where the collector 63 is attached to the expanded upper-end section 61B in the vent pipe 61. Moreover, the vent pipe 61 is provided with a replacement handle 61D to be held when replacing the collector 63 through the attachment port.

The second air blower 64 collects air traveling through the collector 63 at the second end of the vent pipe 61 and blows out the air from the channel space 60.

The second air blower 64 desirably has performance for setting the channel space 60 of the vent pipe 61 to negative pressure. The second air blower 64 desirably includes a housing having an inner wall surface to which particles not collected by the collector 63 may adhere, and is desirably of a type that generates a flow of air that strikes against the inner wall surface of the housing. An example of such a second air blower 64 used includes a multi-blade centrifugal fan.

In the first exemplary embodiment, a sirocco fan, which is one example of a multi-blade centrifugal fan, is used as the second air blower 64.

Furthermore, in the first exemplary embodiment, the second air blower 64 is disposed facing the outlet 67 provided in an upper surface 61Ba of the expanded upper-end section 61B of the vent pipe 61.

Moreover, as shown in FIGS. 2 to 4, in the first exemplary embodiment, exhaust guides 69*a* and 69*b* that guide the air blown out from the second air blower 64 to the exhaust port 13 in the housing 10 of the image forming apparatus 1 are provided. The exhaust guides 69*a* and 69*b* are formed by using, for example, plate-shaped members.

For example, as shown in FIGS. 5 and 6, the sirocco fan as the second air blower 64 is constituted of a housing 641, a shaft 642, and a multi-blade rotating section 643. The housing 641 has a cylindrical accommodation space provided with an intake hole 641*a* in the bottom surface thereof and an exhaust passage 641*b* connecting with a part of the accommodation space. The shaft 642 is rotatably supported by the top surface of the accommodation space of the housing 641 and contains a drive motor (reference sign 645 in FIG. 8). The multi-blade rotating section 643 is attached around the shaft 642, has multiple blades that are evenly arranged in the form of a cylinder, and rotates within the accommodation space of the housing 641.

The sirocco fan is disposed such that the intake hole 641*a* of the housing 641 faces the outlet 67 in the vent pipe 61. Although the exhaust passage 641*b* of the housing 641 in the sirocco fan is configured to discharge air along the upper surface 61Ba of the expanded upper-end section 61B of the vent pipe 61, as shown in FIG. 4, an alternative passage that discharges air in another direction is also permissible.

As shown in FIGS. 5 and 6, the first air blower 62 and the second air blower 64 in the particle collecting device 6 operate such that a first pressure (P1) in a first channel space 60A extending from the first air blower 62 to the collector 63 in the channel space 60 of the vent pipe 61 and a second pressure (P2) in a second channel space 60B extending from the collector 63 to the second air blower 64 in the channel space 60 are maintained to have the relationship "P2<P1≤atmospheric pressure".

Strictly speaking, the atmospheric pressure is the pressure outside the vent pipe 61 when the particle collecting device 6 is operating and is substantially equal to the atmospheric pressure outside the housing 10 of the image forming apparatus 1. The first pressure (P1) is desirably a lower pressure (negative pressure) than the atmospheric pressure or may be equal to the atmospheric pressure. The second pressure (P2) may be lower than the first pressure (P1).

The first pressure (P1) is measured by a first pressure measuring unit 71 disposed within the first channel space 60A. The second pressure (P2) is measured by a second pressure measuring unit 72 disposed within the second channel space 60B. For example, internal pressure gauges capable of measuring negative pressure are used as the first pressure measuring unit 71 and the second pressure measuring unit 72.

Furthermore, the first air blower 62 and the second air blower 64 in the particle collecting device 6 operate such that a first air quantity (Q1) of the first air blower 62 and a second air quantity (Q2) of the second air blower 64 are maintained to have the relationship "Q1<Q2".

The first air quantity (Q1) is obtained in accordance with the rotation speed of the first air blower 62. The second air quantity (Q2) is obtained in accordance with the rotation speed of the second air blower 64. Therefore, the first air quantity (Q1) and the second air quantity (Q2) are adjustable by changing the rotation speed of the first air blower 62 and the rotation speed of the second air blower 64.

Each of the first air quantity (Q1) and the second air quantity (Q2) is normally a quantity of air moved per unit time and is a numerical value ($m^3/h$) obtained as a multiplier of a passing wind speed (m/s) and a passing area ($m^2$). The first air quantity (Q1) and the second air quantity (Q2) in the particle collecting device 6 are measured by using, for example, measuring units, such as anemometers.

Figure 8:
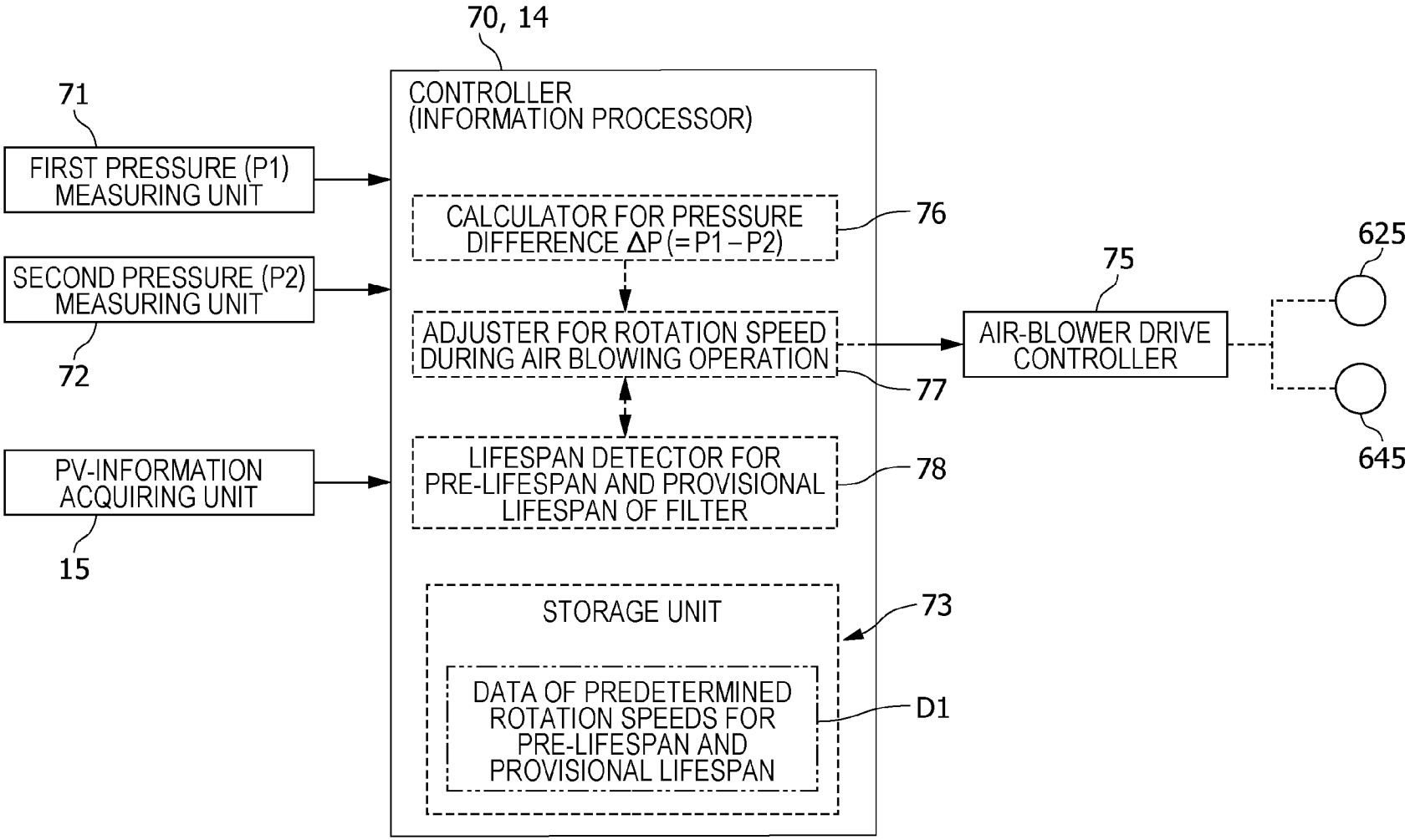
FIG. 8 is a block diagram illustrating the configuration related to control of the particle collecting device in FIG. 2.

As shown in FIG. 8, the particle collecting device 6 has a controller 70 that controls the operation of the particle collecting device 6.

The controller 70 has a configuration identical to that of the controller 14 in the image forming apparatus 1 and is configured as a control system independent of the controller 14 or operates as a part of the controller 14. In a case where the controller 70 is a control system independent of the controller 14, the initiation and termination of the operation of the controller 70 are controlled by the controller 14.

As shown in FIG. 8, the controller 70 is connected to the first pressure measuring unit (measuring unit) 71 that measures the first pressure (P1) in the first channel space 60A of the vent pipe 61, the second pressure measuring unit 72 (measuring unit) that measures the second pressure (P2) in the second channel space 60B of the vent pipe 61, and a PV-information acquiring unit (acquiring unit) 15 that acquires count information of a print volume (PV) of printed sheets 9, and receives information therefrom for control processing.

The first pressure measuring unit 71 and the second pressure measuring unit 72 are constituted of the aforementioned internal pressure gauges disposed within the first channel space 60A and the second channel space 60B, respectively. The PV-information acquiring unit 15 receives PV information counted by the controller 14 of the image forming apparatus 1 and stored in the storage unit.

As shown in FIG. 8, the controller 70 is connected to an air-blower drive controller 75 that controls the driving of the first air blower 62 and the second air blower 64, and outputs necessary control information to the air-blower drive controller 75.

During air blowing operation, the air-blower drive controller 75 controls the operation of a drive motor 625 that drives the first air blower 62 and the operation of a drive motor 645 that drives the second air blower 64, and is also capable of specifically controlling the rotation speeds of the drive motors 625 and 645.

As shown in FIG. 8, the controller 70 has a storage unit 73 that stores a program and data used for control operation and information obtained in the course of the control operation, and also has the following information processing function for processing information based on the program and data used for the control operation.

Examples of the information processing function include a calculator 76 that calculates a pressure difference ΔP between the first pressure (P1) and the second pressure (P2), an adjuster 77 that adjusts the rotation speeds of the first air blower 62 and the second air blower 64 during the air blowing operation, and a lifespan detector 78 that detects whether the filter serving as the collector 63 has reached its pre-lifespan and provisional lifespan.

The calculator 76 for the pressure difference ΔP calculates the pressure difference ΔP (=P1−P2) from the first pressure (P1) obtained from the first pressure measuring unit 71 and the second pressure (P2) obtained from the second pressure measuring unit 72.

The rotation-speed adjuster 77 functions to adjust the rotation speeds of the drive motors 625 and 645 during the air blowing operation so that the pressure difference ΔP obtained by the calculator 76 is maintained within a fixed range set in advance. Although the adjuster 77 desirably adjusts the rotation speeds of both the drive motors 625 and 645 of the first air blower 62 and the second air blower 64, the adjuster 77 may adjust only the rotation speed of the drive motor 645 of the second air blower 64, as described below, so long as the pressure difference ΔP may be maintained within the fixed range.

Moreover, the lifespan detector 78 for the pre-lifespan and the provisional lifespan of the filter detects a time point at which the rotation speeds obtained from the adjuster 77 reach predetermined rotation speeds corresponding to a preset pre-lifespan and a preset provisional lifespan. The pre-lifespan is set to, for example, a time point at which the collection efficiency of the filter decreases by a predetermined rate from an initial value. The provisional lifespan is set to, for example, a time point at which the collection efficiency of the filter further decreases by a predetermined rate from the pre-lifespan value. Data D1 of the predetermined rotation speeds for the pre-lifespan and the provisional lifespan used in the lifespan detector 78 are stored in the storage unit 73.

Furthermore, as shown in FIGS. 4 to 6, the vent pipe 61 in the particle collecting device 6 is provided with a front channel-space section 60C included in the first channel space 60A and extending in the longitudinal direction C of the collector 63 at a position in front of the collector 63.

The front channel-space section 60C is partially provided with the aforementioned inlet 66 that allows air in the first channel space 60A to actually flow into the front channel-space section 60C. Moreover, the front channel-space section 60C is capable of causing air to uniformly come into contact with the entire filter serving as the collector 63 in the longitudinal direction C thereof, and tentatively increases the thickness of the filter.

As shown in FIGS. 4 to 7, with regard to the vent pipe 61 in the particle collecting device 6, the inlet 66 and the outlet 67 are disposed in an offset fashion at different ends of the vent pipe 61 (i.e., the expanded upper-end section 61B) in the longitudinal direction C of the collector 63.

In the first exemplary embodiment, a rectangular opening is provided as the inlet 66, and the inlet 66 extends from one end of the front channel-space section 60C in the expanded upper-end section 61B of the vent pipe 61 in the longitudinal direction C of the collector 63 to a substantially middle position in the longitudinal direction C. Furthermore, in the first exemplary embodiment, a circular opening is provided as the outlet 67, and the outlet 67 is provided in an offset fashion near the other end of the expanded upper-end section 61B of the vent pipe 61 in the longitudinal direction C of the collector 63.

As shown in FIGS. 5 and 6, the front channel-space section 60C of the vent pipe 61 has a first space section 60Ca where the inlet 66 exists and a second space section 60Cb where the inlet 66 does not exist.

Moreover, the front channel-space section 60C is configured such that a distance H2 between the collector 63 and an inner wall surface 68*a* of the second space section 60Cb that faces the collector 63 is smaller than a distance H1 between the collector 63 and an inner wall surface 61Bc of the first space section 60Ca that faces the collector 63 (H2<H1).

The distance H2 in the second space section 60Cb is set to a value of, for example, 2 cm or smaller.

As shown in FIGS. 4 and 6, in the first exemplary embodiment, the second space section 60Cb is provided with a raised section 68 that is located at a position closer to the collector 63 than the inner wall surface 61Bc of the first space section 60Ca and that has the flat inner wall surface 68*a* extending in the longitudinal direction C of the collector 63, whereby the relationship between the aforementioned distances H1 and H2 (H2<H1) is established.

The raised section 68 has a slope 68*b* that is located at an end serving as a boundary with the first space section 60Ca and that is inclined so as to continuously rise toward the inner wall surface 68*a* of the raised section 68 from the inner wall surface 61Bc of the first space section 60Ca.

Operation of Particle Collecting Device

For example, the particle collecting device 6 having the above-described configuration operates as follows.

The particle collecting device 6 operates in conjunction with the operation of the image forming apparatus 1 at least during a period in which the image forming apparatus 1 is operating.

In detail, the particle collecting device 6 operates by causing the controller 70 to drive the drive motor 625 for the first air blower (axial fan) 62 and the drive motor 645 for the second air blower (sirocco fan) 64.

In the particle collecting device 6, the rotation speeds of the first air blower 62 and the second air blower 64 are controlled by the controller 70 so that the first pressure P1 in the first channel space 60A of the vent pipe 61 and the second pressure P2 in the second channel space 60B of the vent pipe 61 are maintained to have the aforementioned specific relationship (P2<P1≤atmospheric pressure).

Figure 9:
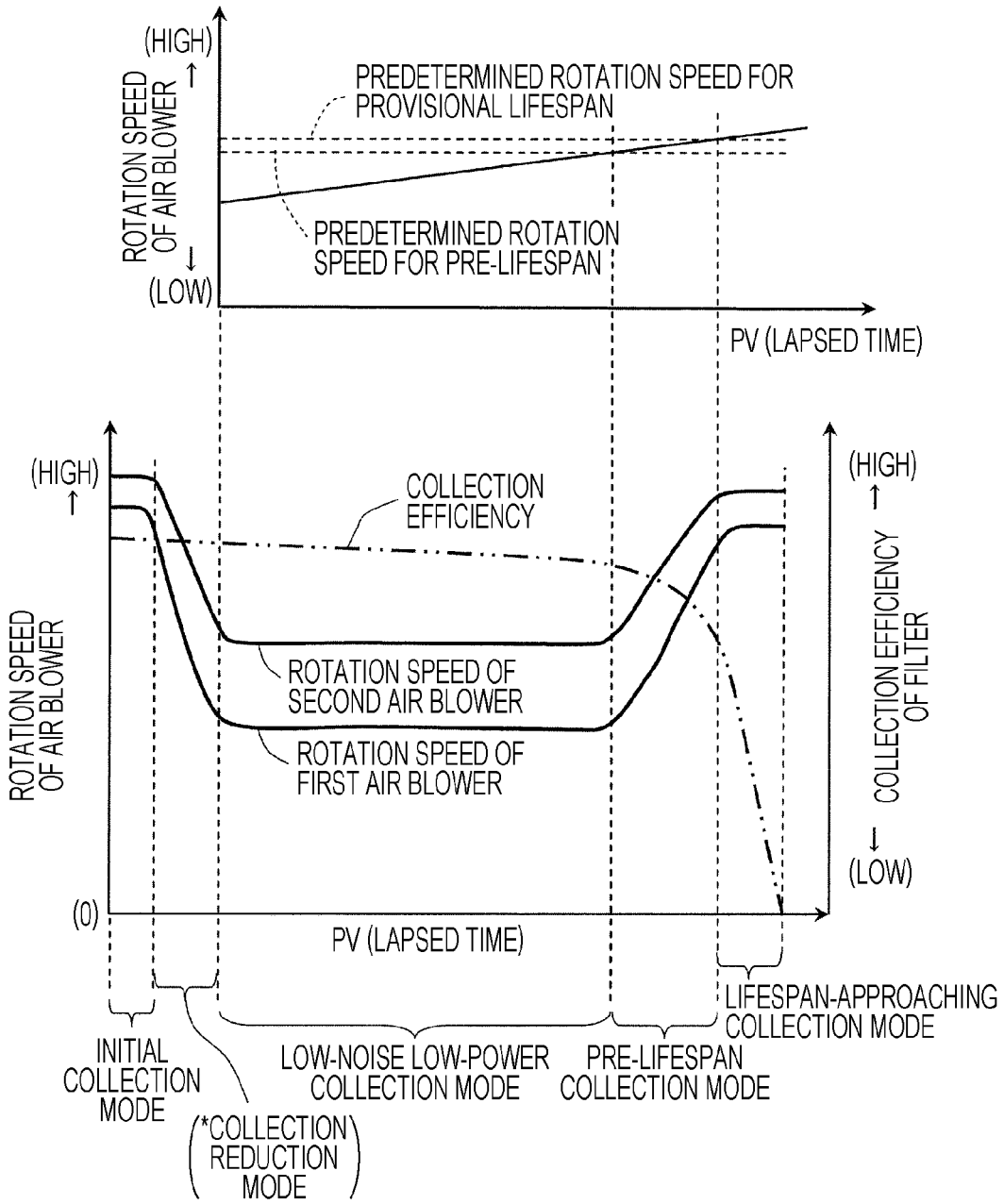
FIG. 9 schematically illustrates an operation example of the particle collecting device in FIG. 2.

Furthermore, in the particle collecting device 6, the controller 70 controls the rotation speeds of the first air blower 62 and the second air blower 64 so that the air quantity Q1 of the first air blower 62 and the air quantity Q2 of the second air blower 64 are maintained to have the aforementioned specific relationship (Q1<Q2). In particular, the first air blower 62 and the second air blower 64 operate such that the relationship Q1<Q2 is maintained, whereby the aforementioned relationship "P2<P1≤atmospheric pressure" may be achieved relatively easily, as compared with a case where the air blowers do not operate in accordance with that relationship. As shown in FIG. 9, the specific relationship related to the air quantities is achieved by maintaining a relationship in which the rotation speed of the second air blower 64 is higher than the rotation speed of the first air blower 62.

Figure 10:
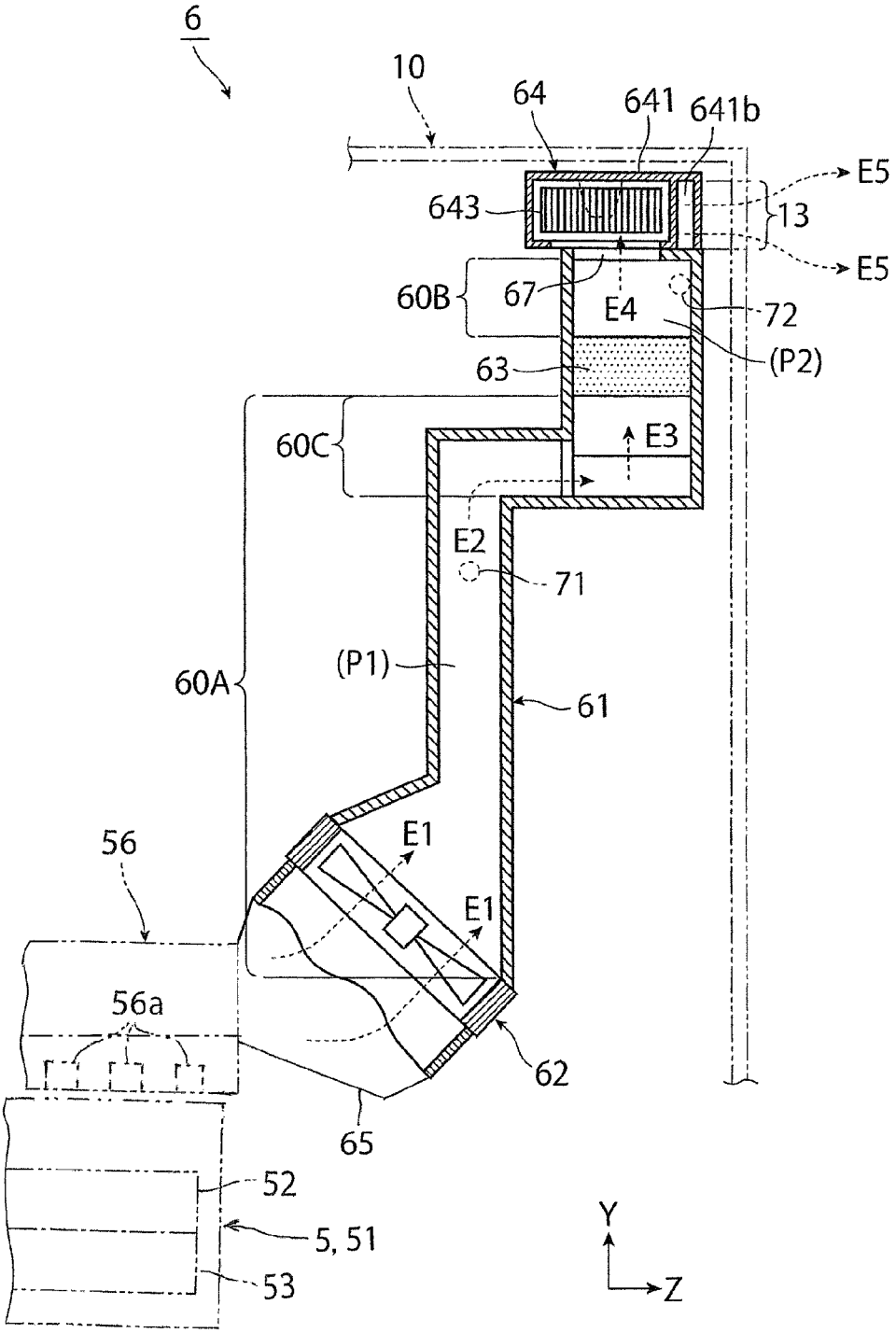
FIG. 10 is a cross-sectional view schematically illustrating the operational state of the particle collecting device in FIG. 2.
Figure 11:
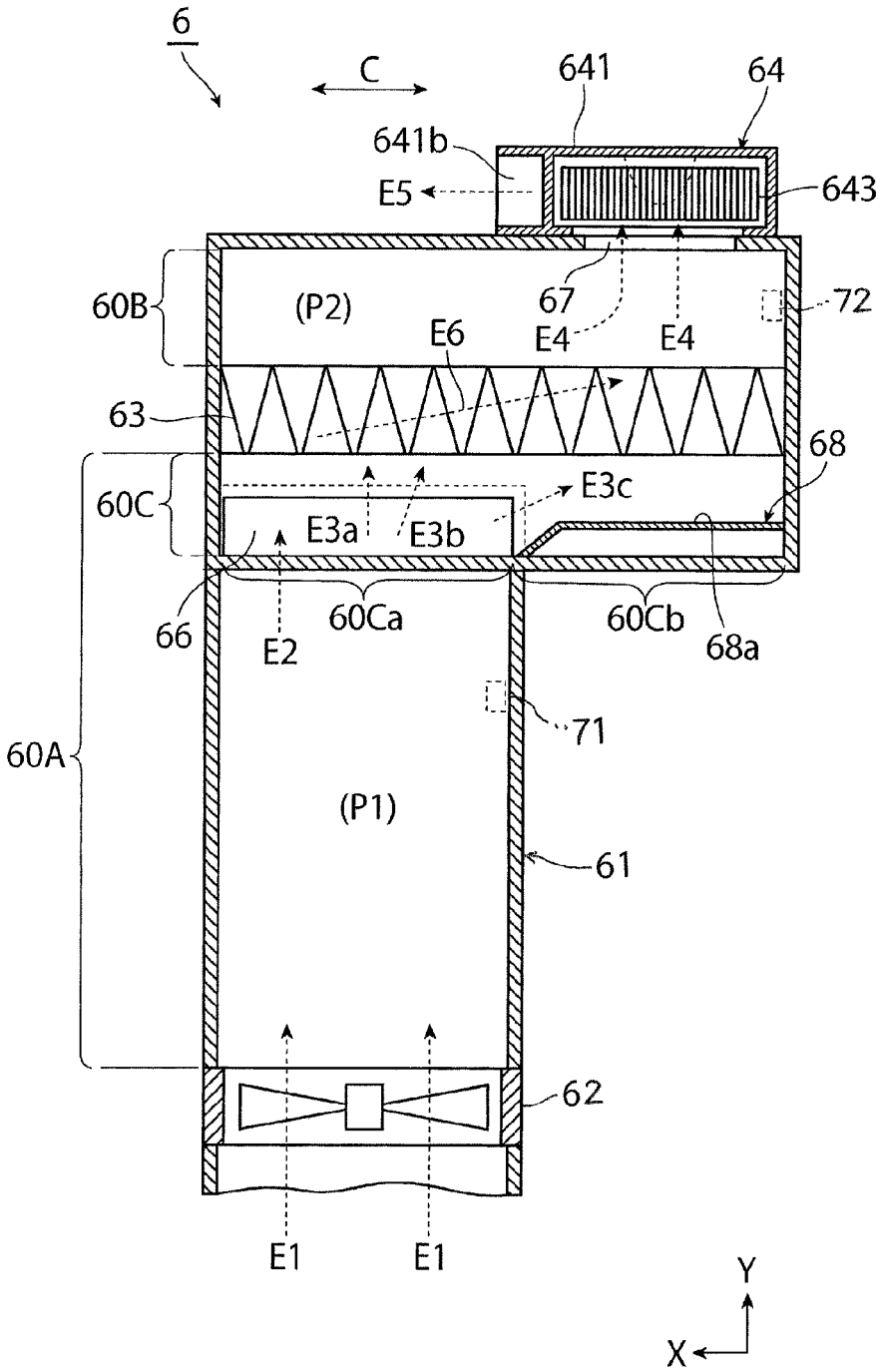
FIG. 11 is a cross-sectional view illustrating the operational state in FIG. 10, as viewed from a different angle.

As shown in FIGS. 10 and 11, when the particle collecting device 6 operates in this manner, the air blowing effect of the first air blower 62 causes air including particles generated in the fixing unit 5 to be collected at the collection duct 56 and to be subsequently delivered to the first channel space 60A of the vent pipe 61 via the collection connector 65, as indicated by an arrow E1.

In this case, because the first air blower 62 is an axial fan, the air including the particles is efficiently collected and is delivered to the first channel space 60A, as compared with a case where the first air blower 62 is not an axial fan.

Subsequently, as shown in FIGS. 10 and 11, the air blowing effect of the second air blower 64 causes the air (E1) to move through the first channel space 60A of the vent pipe 61 and travel through the collector 63, as indicated by arrows E2 and E3. Then, the air is delivered through the outlet 67 from the second channel space 60B, as indicated by an arrow E4. Ultimately, the air (E1) travels through the exhaust passage 641*b* of the second air blower 64 and is discharged outside the housing 10 from the exhaust port 13 in the housing 10 of the image forming apparatus 1, as indicated by an arrow E5.

In this case, the particles included in the air are collected by the collector 63 as the air passes through the collector 63. Consequently, the air delivered from the second air blower 64 becomes filtered air with no particles.

Supposing that there is a particle not collected by the collector 63, since the second air blower 64 is a sirocco fan, the particle is carried to the inner wall surface of the housing 641 by striking against the inner wall surface or coming into contact with the inner wall surface together with the air due to a centrifugal force produced by the rotation of the multi-blade rotating section 643 of the sirocco fan, as compared with a case where the second air blower 64 is not a sirocco fan. As a result, the particle is captured by adhering to the inner wall surface of the accommodation space in the housing 641 or the inner wall surface of the exhaust passage 641*b*.

Accordingly, the particle collecting device 6 operates such that the first pressure P1 in the first channel space 60A and the second pressure P2 in the second channel space 60B in the vent pipe 61 are maintained to have the relationship "P2<P1≤atmospheric pressure", so that the air including the particles generated in the fixing unit 5 passes through the collector 63 without leaking from the vent pipe 61, whereby the particles included in the air are collected by the collector 63.

As shown in FIGS. 10 and 11, in this collecting device 6, the air (E1) delivered into the first channel space 60A of the vent pipe 61 flows into the front channel-space section 60C from the inlet 66, as indicated by the arrow E2, and is subsequently delivered toward the collector 63, as indicated by the arrow E3.

In this case, the air (E2) flowing into the front channel-space section 60C is dispersed within the front channel-space section 60C, which is wider than the inlet 66, before reaching the collector 63, as indicated by arrows E3*a*, E3*b*, and E3*c* in FIG. 11, and subsequently moves in a contactable state with the entire collector 63 in the longitudinal direction C thereof.

Accordingly, in the particle collecting device 6, the entire collector 63 is effectively utilized in the longitudinal direction C thereof, whereby the particles may be efficiently collected.

The air (E2) flowing into the front channel-space section 60C receives the air blowing (suction) effect of the second air blower 64 through the outlet 67 disposed in an offset fashion near the end different from the inlet 66 in the longitudinal direction C of the collector 63.

Accordingly, in the particle collecting device 6, the air passing through the collector 63 moves diagonally through the collector 63 relative to the longitudinal direction C, as indicated by an arrow E6 in FIG. 11, so that the entire collector 63 in the longitudinal direction C thereof is effectively utilized, whereby the particles may be efficiently collected.

Furthermore, the raised section 68 is provided in the second space section 60Cb where the inlet 66 does not exist such that the space between the raised section 68 and the collector 63 is smaller than the first space section 60Ca where the inlet 66 exists. Thus, the air (E2) flowing into the front channel-space section 60C is less likely to flow into the second space section 60Cb, as compared with the first space section 60Ca.

Accordingly, in the particle collecting device 6, the air passing through the collector 63 is more likely to move diagonally through the collector 63, as indicated by the arrow E6 in FIG. 11, so that the entire collector 63 in the longitudinal direction C thereof is effectively utilized, whereby the particles may be efficiently collected.

Furthermore, in this particle collecting device 6, the second space section 60Cb is provided with the raised section 68, so that the collector 63 may be prevented from being locally clogged with particles, as will be described below.

Specifically, supposing that the second space section 60Cb is not provided with the raised section 68, the air blowing (suction) effect of the second air blower 64 acts relatively strong on an area of the collector 63 that faces the outlet 67 via the outlet 67 located in an offset fashion at one end in the longitudinal direction C of the collector 63. Therefore, a large quantity of air passes through this area of the collector 63 that faces the outlet 67, thus causing this area to collect particles in a concentrated manner so as to be locally clogged with particles.

In contrast, in this particle collecting device 6, the air flowing into the front channel-space section 60C is relatively less likely to flow toward the second space section 60Cb provided with the raised section 68, as compared with the first space section 60Ca. As a result, the percentage of air passing through the area of the collector 63 that faces the outlet 67 decreases, so that a state where this area is locally clogged with particles due to collecting particles in a concentrated manner is less likely to occur.

In addition, in this particle collecting device 6, the channel length of the first channel space 60A in the vent pipe 61 is larger than the channel length of the second channel space 60B.

Accordingly, the air including the particles delivered into the first channel space 60A of the vent pipe 61 in accordance with the air blowing effect of the first air blower 62 is retained for a relatively longer period of time in the first channel space 60A than in the second channel space 60B. Therefore, in the particle collecting device 6, the particles included in the air come into contact with the inner wall surface of the first channel space 60A at an increased percentage before passing through the collector 63, as compared with a case where the channel length of the first channel space 60A is smaller than the channel length of the second channel space 60B, whereby the particles are more likely to be captured by adhering to the inner wall surface.

Then, in the particle collecting device 6, the rotation speeds of the first air blower 62 and the second air blower 64 are controlled by the controller 70 in the following manner.

Specifically, in the particle collecting device 6, the pressure difference ΔP calculator 76 in the controller 70 calculates a pressure difference ΔP (=P1−P2) by using measurement information about the first pressure P1 and the second pressure P2 respectively measured by the first pressure measuring unit (measuring unit) 71 and the second pressure measuring unit (measuring unit) 72, and the rotation-speed adjuster 77 in the controller 70 adjusts the rotation speed of the first air blower 62 and the rotation speed of the second air blower 64 by appropriate amounts so that the calculated pressure difference ΔP is set within a predetermined fixed numerical range.

As shown in FIG. 9, this control is performed for maintaining the relationship "P2<P1≤atmospheric pressure" based on the fact that the penetration efficiency (air resistance) in the collector 63 fluctuates due to the collection efficiency of the filter serving as the collector 63 fluctuating in the decreasing direction as the filter is used, and that the first pressure P1 and the second pressure P2 also fluctuate due to this effect.

The fixed numerical range for the pressure difference Δ is demanded for maintaining a difference value in the relationship "P2<P1" set in advance based on the relationship "P2<P1≤atmospheric pressure". In this case, although the rotation speeds of both the first air blower 62 and the second air blower 64 are adjusted, the air quantity Q1 of the first air blower 62 and the air quantity Q2 of the second air blower 64 are adjusted so that the aforementioned relationship "Q1<Q2" is maintained in either adjustment stage.

Furthermore, because particles tend to be generated in the fixing unit 5 the most when the fixing unit 5 is new, the particle collecting device 6 executes an "initial collection mode" of controlling both the first air blower 62 and the second air blower 64 in accordance with that timing such that the rotation speeds thereof are maintained in a relatively high range, as shown in FIG. 9.

This initial collection mode ends when, for example, the print volume (PV) of printed sheets reaches a predetermined sheet value from the start point of use of the new fixing unit 5. This end timing is determined by the controller 70 acquiring and detecting information about the print volume from the PV-information acquiring unit 15. The predetermined sheet value is set to, for example, 2,800 sheets.

In the particle collecting device 6, control is performed based on this initial collection mode so that a large number of particles generated when the fixing unit 5 is new are properly collected.

After the control period of the initial collection mode, the number of particles generated in the fixing unit 5 tends to start decreasing in the particle collecting device 6. Therefore, the particle collecting device 6 executes a "collection reduction mode" of controlling both the first air blower 62 and the second air blower 64 in accordance with that timing such that the rotation speeds thereof change in the decreasing direction, as shown in FIG. 9.

In this collection reduction mode, the rotation speeds of both the first air blower 62 and the second air blower 64 are continuously decreased at a fixed rate at a predetermined timing or are decreased in a stepwise fashion in accordance with the PV information. The collection reduction mode ends when, for example, the information about the print volume reaches a predetermined sheet value different from the predetermined sheet value for the initial collection mode.

In the particle collecting device 6, control is performed based on this collection reduction mode so that particles are appropriately collected in correspondence with the generation status of particles.

Alternatively, this collection reduction mode may be omitted. In this case, a transition is immediately made to a low-noise low-power collection mode upon completion of the initial collection mode.

After the control period of the collection reduction mode (or the initial collection mode), the number of particles generated in the fixing unit 5 decreases in the particle collecting device 6. Therefore, the particle collecting device 6 executes a "low-noise low-power collection mode" of controlling both the first air blower 62 and the second air blower 64 in accordance with that timing such that the rotation speeds thereof are maintained at relatively-low minimal values selected from the standpoint of prioritizing low noise and low power consumption, as shown in FIG. 9.

In the low-noise low-power collection mode, the first air blower 62 and the second air blower 64 are similarly controlled for adjusting the rotation speeds thereof such that the pressure difference ΔP is maintained within a fixed range. This point is similar to the case of the above-described collection reduction mode and other collection modes to be described later.

Furthermore, as shown in FIG. 9, the low-noise low-power collection mode starts when the collection reduction mode (or the initial collection mode) ends, and ends when the filter serving as the collector 63 reaches its pre-lifespan.

In the particle collecting device 6, control is performed based on this low-noise low-power collection mode so that particles are appropriately collected while low noise and low power consumption are achieved.

The lifespan detector 78 provided in the controller 70 for detecting whether the filter has reached its pre-lifespan and provisional lifespan detects that the filter has reached its pre-lifespan. In this case, as shown in the upper part of FIG. 9, the detection by the lifespan detector 78 is performed by determining the timing at which the rotation speeds of the air blowers reach a predetermined rotation speed corresponding to a predetermined pre-lifespan.

The predetermined rotation speed for the pre-lifespan in this case is set as a rotation speed corresponding to a timing at which the collection efficiency of the filter is predicted to decrease by about 10% from the initial value with reference to actual measurement results obtained from tests.

Furthermore, it is determined that the filter has reached its pre-lifespan by detecting that the rotation speed of the second air blower 64 has reached the predetermined rotation speed. Alternatively, it may be determined that the filter has reached its pre-lifespan by detecting that the rotation speed of the first air blower 62 and the rotation speed of the second air blower 64 have individually reached predetermined separately-set rotation speeds.

After the control period of the low-noise low-power collection mode, the collection efficiency of the filter serving as the collector 63 starts decreasing. Therefore, the particle collecting device 6 executes a "pre-lifespan collection mode" of controlling both the first air blower 62 and the second air blower 64 in accordance with that timing such that the rotation speeds thereof are increased to compensate for the decrease in the collection efficiency of the filter, as shown in FIG. 9.

Furthermore, as shown in FIG. 9, the pre-lifespan collection mode ends when the filter serving as the collector 63 reaches its provisional lifespan.

In the particle collecting device 6, control is performed based on this pre-lifespan collection mode so that particles are appropriately collected while the decrease in the collection efficiency of the filter serving as the collector 63 is compensated for.

The lifespan detector 78 provided in the controller 70 for detecting whether the filter has reached its pre-lifespan and provisional lifespan detects that the filter has reached its provisional lifespan. In this case, as shown in the upper part of FIG. 9, the detection by the lifespan detector 78 is performed by determining the timing at which the rotation speeds of the air blowers reach a predetermined rotation speed corresponding to a predetermined provisional lifespan.

The predetermined rotation speed for the provisional lifespan in this case is set as a rotation speed corresponding to a timing at which the collection efficiency of the filter is predicted to decrease by about 20% from the initial value with reference to actual measurement results obtained from tests.

The determination of whether the filter has reached its provisional lifespan is performed similarly to the case of the determination of whether the filter has reached its pre-lifespan.

Finally, after the control period of the pre-lifespan collection mode, the collection efficiency of the filter serving as the collector 63 further decreases to approach the inherent lifespan of the filter. Therefore, as shown in FIG. 9, the particle collecting device 6 executes a "lifespan-approaching collection mode" of controlling both the first air blower 62 and the second air blower 64 in accordance with that timing such that the rotation speeds thereof are maintained in a relatively high range to further compensate for the decrease in the collection efficiency of the filter, as shown in FIG. 9.

As shown in FIG. 9, the lifespan-approaching collection mode ends when the collection efficiency of the filter becomes zero.

In the particle collecting device 6, control is performed based on this lifespan-approaching collection mode so that particles are collected until the filter reaches its inherent lifespan while the decrease in the collection efficiency of the filter serving as the collector 63 is further compensated for.

In this particle collecting device 6, for example, a warning prompting the user to replace the collector 63 may be displayed on, for example, the operable unit 12 of the image forming apparatus 1 when the filter serving as the collector 63 reaches its provisional lifespan.

Modifications

The present disclosure is not limited to the contents described in the first exemplary embodiment and permits various modifications. For example, the present disclosure includes the following modifications.

With regard to the particle collecting device 6, a vent pipe of another type may be used as the vent pipe 61 (including the channel space 60), an air blower other than an axial fan may be used as the first air blower 62, an air blower other than a sirocco fan may be used as the second air blower 64, or another type of a filter may be used as the collector 63, so long as at least the relationship "$P2<P1\leq$atmospheric pressure" may be maintained during the operation of the particle collecting device 6.

Moreover, the operation (including control operation) of the particle collecting device 6 is not limited to the operation example described in the first exemplary embodiment. The particle collecting device 6 may be configured to perform different operation.

For example, the vent pipe 61 may have, as the first channel space 60A, a channel space extending substantially linearly to the first air blower 62 and having a width equal to the length of the collector 63 in the longitudinal direction C. Moreover, the vent pipe 61 may be a vent pipe not having the front channel-space section 60C. Furthermore, the vent pipe 61 may have, as the aforementioned front channel-space section 60C, a front channel-space section whose inner wall surface facing the collector 63 in the longitudinal direction C of the collector 63 is separated from the collector 63 by the same distance entirely in the longitudinal direction C.

Figure 12A:
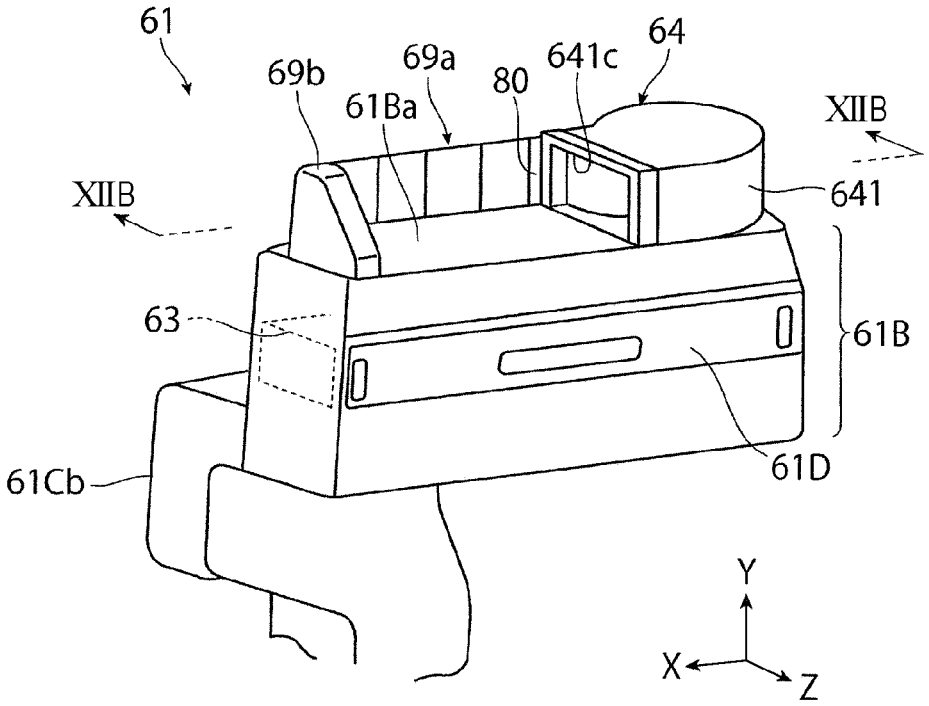
FIG. 12A is a perspective view schematically illustrating a part of a particle collecting device according to a modification.
Figure 12B:
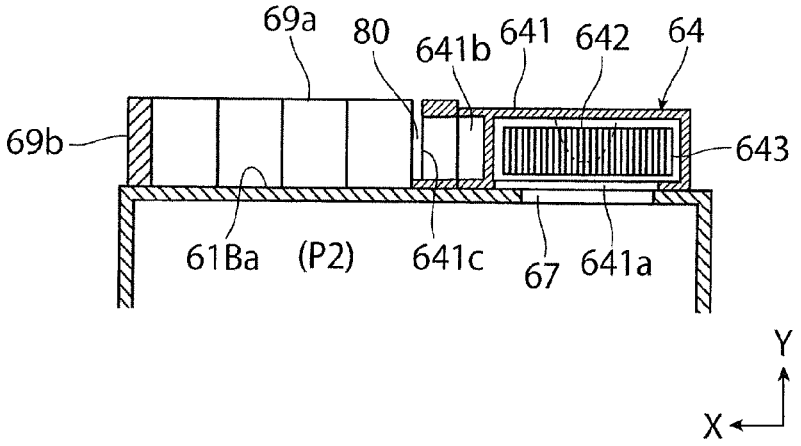
FIG. 12B is a cross-sectional view schematically illustrating the part of the particle collecting device, taken along line XIIB-XIIB in FIG. 12A.
Figure 13:
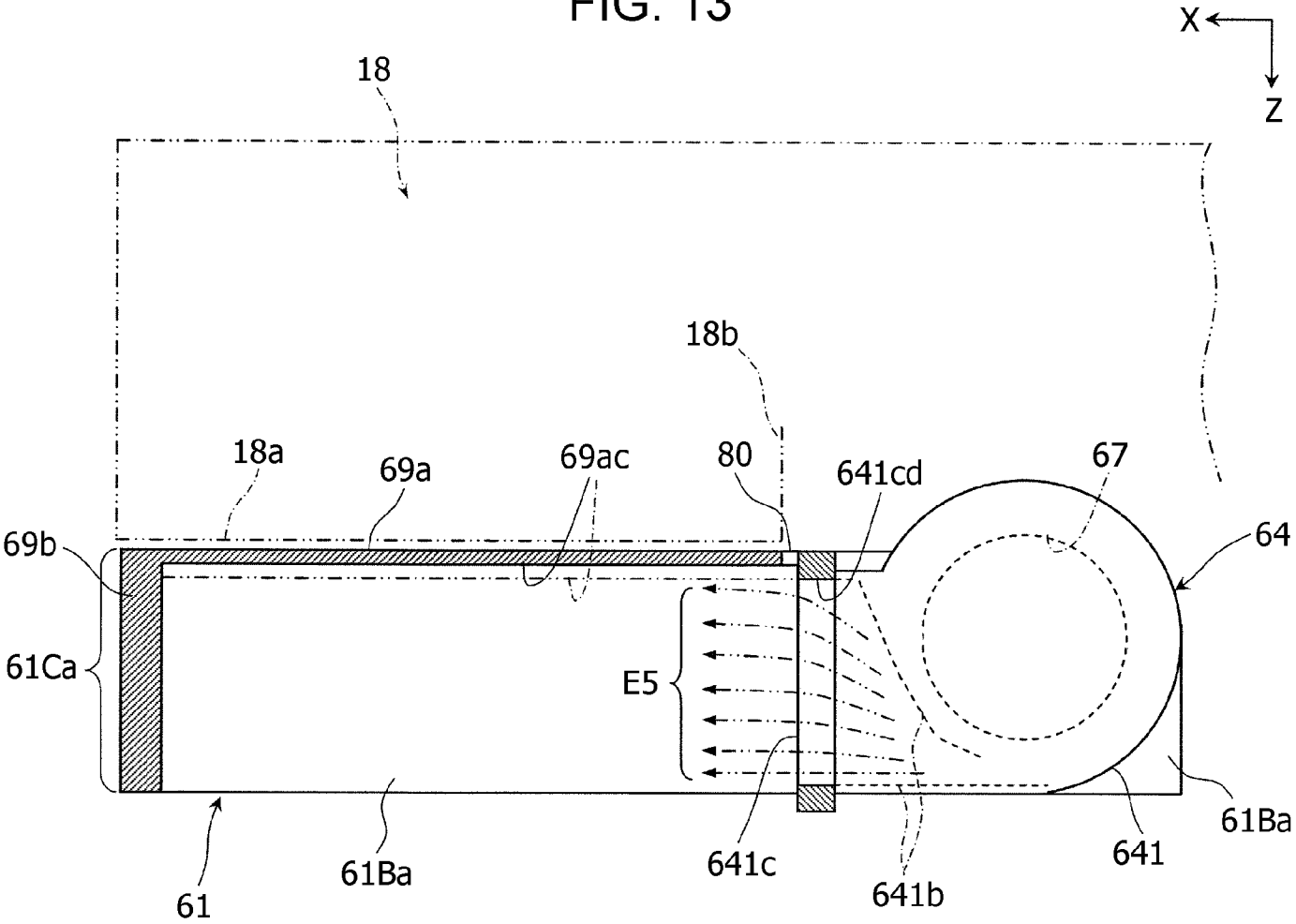
FIG. 13 is a plan view schematically illustrating the part of the particle collecting device, taken along a certain line in FIGS. 12A and 12B.

Furthermore, as shown in FIGS. 12A to 13, the particle collecting device 6 may be provided with an opening 80 between the exhaust guide 69*a* and a terminal port 641*c* of the exhaust passage 641*b* of the sirocco fan serving as the second air blower 64 disposed on the upper surface 61Ba of the vent pipe 61.

As shown in FIG. 13, the opening 80 may be provided in a case where the particle collecting device 6 (the second air blower 64 and the exhaust passage thereof at the upper part of the vent pipe 61) is disposed adjacent to another space section 18 in the housing 10 of the image forming apparatus 1. This is effective since a function for easily discharging air from the neighboring space section 18 is readily obtained. Reference signs 18*a* and 18*b* in FIG. 13 indicate partition walls. The neighboring space section 18 is where, for example, components that generate heat are disposed.

Furthermore, as indicated by a two-dot chain-line arrow in FIG. 13, the opening 80 has to be provided in a state where, for example, the opening 80 faces the channel of air (E5) flowing with directivity and is contactable with the flow of the air (airflow). In addition, between the terminal port 641*c* of the exhaust passage 641*b* and the opening 80, the opening 80 has to be configured such that it does not have a channel shape or other components that may hinder or change the flow of the air (E5).

The opening 80 shown in FIGS. 12A and 12B has a rectangular shape that is long in the vertical direction, which is parallel to the direction of the gravitational force, between the terminal port 641*c* of the exhaust passage 641*b* and one end of the exhaust guide 69*a*.

Moreover, as shown in FIG. 13, the opening 80 is formed between the exhaust guide 69*a* and the terminal port 641*c* of the exhaust passage 641*b* by disposing a plate-shaped member serving as the exhaust guide 69*a* such that an inner wall surface 69*ac* thereof is located at a position displaced outward relative to an inner wall 641*cd* at the terminal port 641*c* of the exhaust passage 641*b*.

Furthermore, the opening 80 is oriented in a direction substantially orthogonal to the exhaust direction at the terminal port 641*c* of the exhaust passage 641*b* of the sirocco fan.

Figure 14:
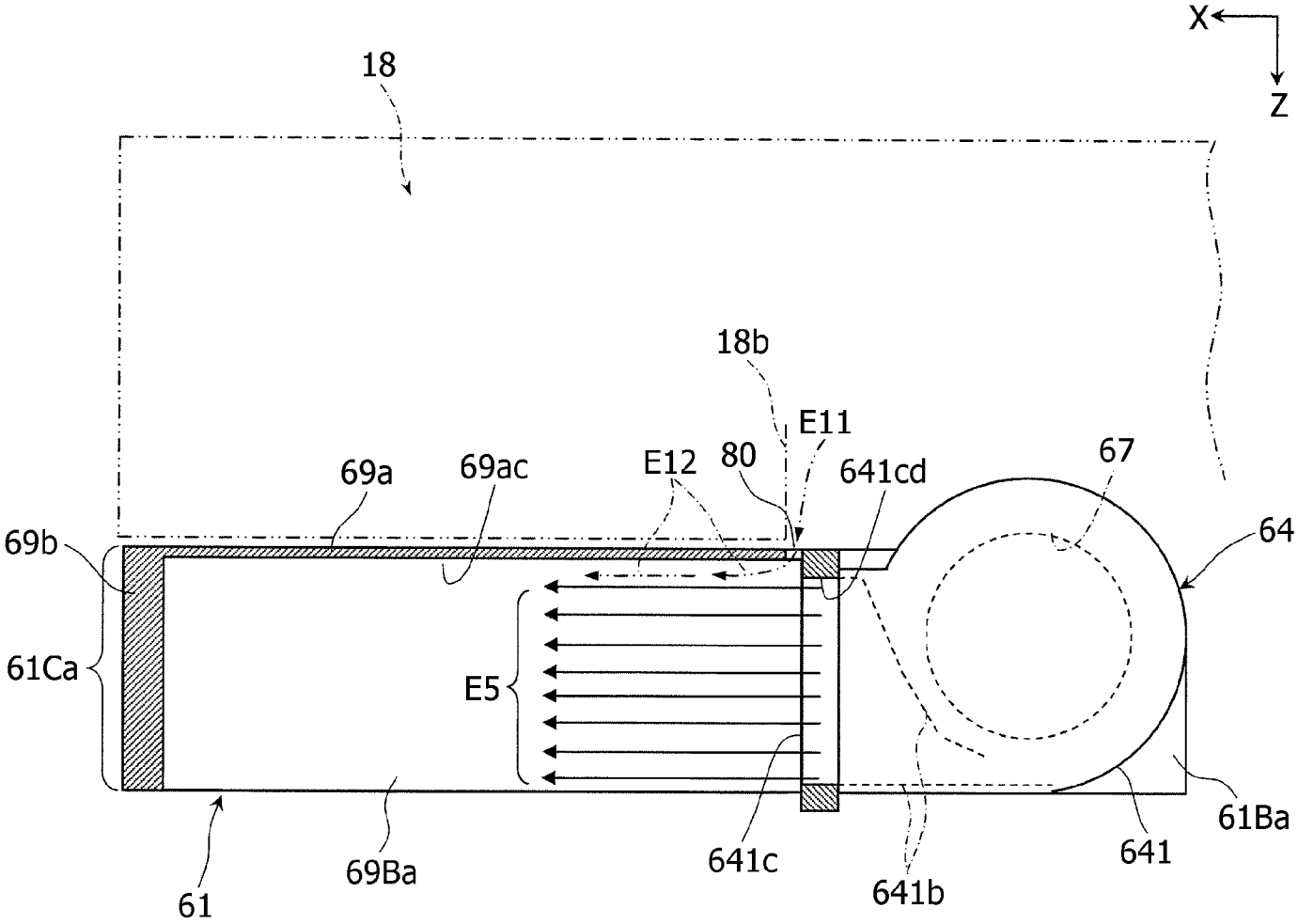
FIG. 14 is a plan view schematically illustrating the operational state in the part of the particle collecting device, taken along a certain line in FIGS. 12A and 12B.

In the image forming apparatus 1 including the particle collecting device 6 provided with the opening 80, when the particle collecting device 6 is actuated and causes the sirocco fan serving as the second air blower 64 to operate, the air discharged from the sirocco fan travels through the exhaust passage 641*b* and flows through an exhaust passage surrounded by the upper surface 61Ba of the vent pipe 61 and the exhaust guides 69*a* and 69*b* from the terminal port 641*c* as the air E5 having directivity substantially in the longitudinal direction of the exhaust passage, as shown in FIGS. 13 and 14. The air E5 in this case is ultimately discharged outward from the exhaust port 13 (FIG. 5) of the housing 10.

As shown in FIG. 14, in the opening 80, air E11 existing in the space section 18 located adjacent to the exhaust passage of the second air blower 64 at the upper part of the vent pipe 61 of the particle collecting device 6 within the housing 10 is suctioned toward the flow of air E5 flowing through the exhaust passage across from the opening 80.

Accordingly, as shown in FIG. 14, the air E11 existing in the neighboring space section 18 enters the exhaust passage surrounded by the upper surface 61Ba of the vent pipe 61 and the exhaust guides 69*a* and 69*b* via the opening 80, subsequently merges with the flow of the air E5 within the exhaust passage so as to flow as air E12 along the inner wall surface 69*ac* of the exhaust guide 69*a*, and is ultimately discharged outward together with the air E5 via the exhaust port 13 (FIG. 5).

As a result, in a case where the air E11 existing in the neighboring space section 18 includes excess heat, the air E11 including the heat may be easily discharged without providing a dedicated device, such as an exhaust device.

In the first exemplary embodiment, the particle collecting device 6 is used as a collecting device that collects particles generated in the fixing unit 5 of the image forming apparatus 1. Alternatively, the particle collecting device 6 may be used as a collecting device that collects particles generated from a component other than the fixing unit 5 of the image forming apparatus 1. Moreover, the particle collecting device 6 may be used in various types of apparatuses other than an image forming apparatus if particles have to be collected.

The image forming apparatus that uses the particle collecting device 6 is not limited to the type described in the first exemplary embodiment and may alternatively be of another type that utilizes electrophotography. As another alternative, the image forming apparatus that uses the particle collecting device 6 may be an image forming apparatus that employs an image forming method other than electrophotography (such as a liquid-droplet jet method or a print method).

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A particle collecting device comprising:

a vent pipe having a channel space through which air flows;

a first air blower that delivers air including a particle at a first end of the vent pipe into the channel space;

a collector that is disposed to block a channel in the channel space at an intermediate part of the vent pipe and that collects the particle included in the air delivered by the first air blower; and a second air blower that collects the air traveling through the collector at a second end of the vent pipe and that delivers the air from the channel space, wherein the first air blower and the second air blower operate such that a first pressure in a first channel space extending from the first air blower to the collector and a second pressure in a second channel space extending from the collector to the second air blower are maintained to have a relationship in which the second pressure<the first pressure≤atmospheric pressure, the first channel space and the second channel space being included in the channel space of the vent pipe, wherein the vent pipe has a front channel-space section included in the first channel space and extending in a longitudinal direction of the collector at a position in front of the collector, an inlet through which air flows into the front channel-space section, and an outlet through which air existing in the second channel space after traveling through the collector is discharged to the second air blower, and wherein the inlet and the outlet are disposed in an offset fashion at different ends in the longitudinal direction of the collector, wherein the front channel-space section has a first space section where the inlet exists and a second space section where the inlet does not exist, and wherein a distance between the collector and an inner wall surface of the second space section that faces the collector is smaller than a distance between the collector and an inner wall surface of the first space section that faces the collector.

2. The particle collecting device according to claim 1, wherein the first air blower and the second air blower operate such that a first air quantity of the first air blower and a second air quantity of the second air blower are maintained to have a relationship in which the first air quantity<the second air quantity.

3. The particle collecting device according to claim 2, wherein the first air blower is an axial fan.

4. The particle collecting device according to claim 1, wherein the first air blower is an axial fan.

5. The particle collecting device according to claim 1, wherein the second air blower is a sirocco fan.

6. An image forming apparatus comprising:

the particle collecting device according to claim 1.

7. The image forming apparatus according to claim 6, further comprising:

a fixing unit that causes a recording medium retaining an unfixed image to pass through the fixing unit so as to fix the unfixed image onto the recording medium, wherein the particle collecting device is disposed such that the first end of the vent pipe at which the first air blower is disposed is connected to the fixing unit.

8. The particle collecting device according to claim 1, wherein the first air blower comprises a plurality of first blades and the second air blower comprises a plurality of second blades.

9. A particle collecting device comprising:

a vent pipe having a channel space through which air flows;

first air blowing means for delivering air including a particle at a first end of the vent pipe into the channel space;

collecting means, disposed to block a channel in the channel space at an intermediate part of the vent pipe, for collecting the particle included in the air delivered by the first air blowing means; and second air blowing means for collecting the air traveling through the collector collecting means at a second end of the vent pipe and delivering the air from the channel space, wherein the first air blowing means and the second air blowing means operate such that a first pressure in a first channel space extending from the first air blowing means to the collecting means and a second pressure in a second channel space extending from the collecting means to the second air blowing means are maintained to have a relationship in which the second pressure<the first pressure≤atmospheric pressure, the first channel space and the second channel space being included in the channel space of the vent pipe, wherein the vent pipe has a front channel-space section included in the first channel space and extending in a longitudinal direction of the collecting means at a position in front of the collecting means, an inlet through which air flows into the front channel-space section, and an outlet through which air existing in the second channel space after traveling through the collecting means is discharged to the second air blower, and wherein the inlet and the outlet are disposed in an offset fashion at different ends in the longitudinal direction of the collecting means, wherein the front channel-space section has a first space section where the inlet exists and a second space section where the inlet does not exist, and wherein a distance between the collecting means and an inner wall surface of the second space section that faces the collecting means is smaller than a distance between the collecting means and an inner wall surface of the first space section that faces the collecting means.

* * * * *